US005678393A

United States Patent [19]

Yuyama et al.

[11] Patent Number: 5,678,393

[45] Date of Patent: Oct. 21, 1997

[54] DRUG PACKING APPARATUS

[75] Inventors: Shoji Yuyama; Kunihiko Kano; Hirotaka Hayashi, all of Toyonaka, Japan

[73] Assignee: Kabushiki Kaisha Yuyama Seisakusho, Osaka, Japan

[21] Appl. No.: 580,995

[22] Filed: Jan. 3, 1996

[30] Foreign Application Priority Data

Jan. 10, 1995 [JP] Japan ..... 7-002162

[51] Int. Cl.[6] ..... B65B 35/12; B65B 57/10; B65B 1/06; B65B 1/40

[52] U.S. Cl. ..... 53/493; 53/52; 53/168; 53/237

[58] Field of Search ..... 53/493, 495, 502, 53/503, 501, 52, 77, 168, 237, 238, 154, 155

[56] References Cited

U.S. PATENT DOCUMENTS

| | | | |
|---|---|---|---|
| 4,607,478 | 8/1986 | Maglecic | 53/502 |
| 5,010,929 | 4/1991 | Tisma | 53/168 X |
| 5,174,472 | 12/1992 | Raque et al. | 53/493 X |
| 5,481,855 | 1/1996 | Yuyama | 53/168 X |
| 5,502,944 | 4/1996 | Kraft et al. | 53/168 X |
| 5,533,606 | 7/1996 | Yuyama | 53/168 X |

*Primary Examiner*—James F. Coan
*Attorney, Agent, or Firm*—Wenderoth, Lind & Ponack

[57] ABSTRACT

A drug packing apparatus capable of packing drug efficiently irrespective of the distances between a drug packing position and drug storage positions. Drugs dropped from one of a plurality of feeders in one of a plurality of feeder units are stopped by a first intermediate impeller. The drugs are then dropped onto a second intermediate impeller, and then into a discharge hole in a hopper and stopped by a hopper cover. By opening the hopper cover, the drugs on the hopper cover drop into the folded packing sheet. By rotating heater rollers by 180°, a pouch is formed with the drugs packed therein.

6 Claims, 17 Drawing Sheets

FIG. 4

23

| FEEDER NO. | DRUG NAME | DRUG CHARACTERISTIC |
|---|---|---|
| 1-1, 3-1 | H | T7 |
| 1-1, 3-2 | G | T6 |
| 1-1, 3-3 | E | T5 |
| 1-1, 3-4 | B | T5 |
| 1-1, 3-5 | A | T4 |
| 1-1, 3-6 | I | T2 |
| 1-2, 3-1 | J | T2 |
| ⋮ | ⋮ | ⋮ |
| 1-2, 3-3 | F | T5 |
| 1-2, 3-4 | C | T6 |
| ⋮ | ⋮ | ⋮ |
| 1-3, 3-4 | D | T1 |
| ⋮ | ⋮ | ⋮ |

FIG. 5

24

| DRUG CHARACTERISTIC | DRUG SHAPE | MOVING TIME tm (sec) |
|---|---|---|
| T1 | DRUM SHAPED TABLET | 1.9 |
| T2 | ELLIPTICAL TABLET | 1.6 |
| T3 | ELLIPTICAL CAPSULE | 1.5 |
| T4 | CLOVER-SHAPED TABLET | 1.4 |
| T5 | VIAL | 1.0 |
| T6 | AMPULE | 0.8 |
| T7 | SPHERICAL TABLET | 0.6 |

FIG. 6

25

| FEEDER NO. | FIRST CHARACTERISTIC OF FEEDER |
|---|---|
| 1-1, 3-1 | H1 |
| 1-1, 3-2 | H2 |
| 1-1, 3-3 | H3 |
| 1-1, 3-4 | H4 |
| 1-1, 3-5 | H5 |
| 1-1, 3-6 | H6 |
| 1-2, 3-7 | H1 |
| ⋮ | ⋮ |
| 1-2, 3-3 | H3 |
| 1-2, 3-4 | H4 |
| ⋮ | ⋮ |
| 1-3, 3-4 | H4 |
| ⋮ | ⋮ |

FIG. 7

26

| FIRST CHARACTERISTIC OF FEEDER | FEEDER POSITION | DROPPING TIME ts (sec) |
|---|---|---|
| H1 | BETWEEN FIRST SHUTTER AND SECOND SHUTTER | 0 |
| H2 | | 0.1 |
| H3 | | 0.1 |
| H4 | OVER SECOND SHUTTER | 0 |
| H5 | | 0.1 |
| H6 | | 0.1 |

(a) DRUG DROPPED
(b) DRUG DROPPED
(c) FIRST SHUTTER OPEN CLOSED
(d) DRUG DROPPED
(e) DRUG DROPPED
(f) SECOND SHUTTER OPEN CLOSED
(g) DRUG MOVING
(h) HOPPER COVER OPEN CLOSED
(i) POSITION SENSOR
(j) PRINTER
t1 t2 t3 t4 t5 t6 t7 t8 t9 t10 t11 t12 t13 t14 t15 t16 t17
ti1 ti2 ti3 ti4 ti5 ti6
ts
tm
x5

FIG. 10

| DRUG NAME | A | B | E | C | F | D | G | H |
|---|---|---|---|---|---|---|---|---|
| TOTAL NUMBER | 7 | 14 | 14 | 7 | 7 | 7 | 7 | 35 |

| | NAME | FEEDER NO. | H4 ~ H6 | NAME | FEEDER NO. | H4 ~ H6 | NAME | FEEDER NO. | H4 ~ H6 |
|---|---|---|---|---|---|---|---|---|---|
| | NUMBER | $t_s$ | $t_m$ | NUMBER | $t_s$ | $t_m$ | NUMBER | $t_s$ | $t_m$ |
| MORNING | A | 1-1, 3-5 | YES | B | 1-1, 3-4 | YES | E | 1-1, 3-3 | NO |
| | 1 | 0.1 | 1.4 | 2 | 0 | 1.0 | 2 | 0.1 | 1.0 |
| NOON | C | 1-2, 3-4 | YES | F | 1-2, 3-3 | NO | | | |
| | 1 | 0 | 0.8 | 1 | 0.1 | 1.0 | | | |
| EVENING | D | 1-3, 3-4 | YES | G | 1-1, 3-2 | NO | H | 1-1, 3-1 | NO |
| | 1 | 0 | 1.9 | 1 | 0.1 | 0.8 | 5 | 0 | 0.6 |

FIG. 11A

27

| | DRUG NAME |
|---|---|
| FIRST SHUTTER | A, B |
| SECOND SHUTTER | |
| HOPPER COVER | |

FIG. 11B

27

| | DRUG NAME |
|---|---|
| FIRST SHUTTER | C |
| SECOND SHUTTER | A, B, E |
| HOPPER COVER | |

FIG. 11C

27

| | DRUG NAME |
|---|---|
| FIRST SHUTTER | D |
| SECOND SHUTTER | C, F |
| HOPPER COVER | A, B, E |

FIG. 11D

27

| | DRUG NAME |
|---|---|
| FIRST SHUTTER | A, B |
| SECOND SHUTTER | D, G, H |
| HOPPER COVER | C, F |

FIG. 11E

27

| | DRUG NAME |
|---|---|
| FIRST SHUTTER | C |
| SECOND SHUTTER | A, B, E |
| HOPPER COVER | D, G, H |

FIG. 13

32

| FEEDER NO. | DRUG NAME | DRUG CHARACTERISTIC |
|---|---|---|
| 31-1, 3-1 | H | T'5 |
| 31-1, 3-2 | G | T'1 |
| 31-1, 3-3 | E | T'4 |
| 31-1, 3-4 | B | T'5 |
| 31-1, 3-5 | A | T'6 |
| 31-1, 3-6 | I | T'2 |
| 31-2, 3-1 | J | T'2 |
| ⋮ | ⋮ | ⋮ |
| 31-5, 3-1 | P | T'2 |
| 31-5, 3-2 | Q | T'2 |
| 31-5, 3-3 | R | T'4 |
| ⋮ | ⋮ | ⋮ |

FIG. 14

33

| DRUG CHARACTERISTIC | DRUG SHAPE | MOVING TIME (cm/sec) Vm |
|---|---|---|
| T'1 | DRUM SHAPED TABLET | 27 |
| T'2 | ELLIPTICAL TABLET | 31 |
| T'3 | ELLIPTICAL CAPSULE | 33 |
| T'4 | CLOVER-SHAPED TABLET | 36 |
| T'5 | VIAL | 57 |
| T'6 | AMPULE | 60 |
| T'7 | SPHERICAL TABLET | 80 |

FIG. 15

34

| FEEDER NO. | 1ST CHARACTERISTIC OF FEEDER | 2ND CHARACTERISTIC OF FEEDER |
|---|---|---|
| 31-1, 3-1 | H1 | J1 |
| 31-1, 3-2 | H2 | J1 |
| 31-1, 3-3 | H3 | J1 |
| 31-1, 3-4 | H4 | J1 |
| 31-1, 3-5 | H5 | J1 |
| 31-1, 3-6 | H6 | J1 |
| 31-2, 3-1 | H1 | J1 |
| ≈ | ≈ | ≈ |
| 31-5, 3-1 | H1 | J2 |
| 31-5, 3-2 | H2 | J2 |
| 31-5, 3-3 | H3 | J2 |
| ⋮ | ⋮ | ⋮ |

FIG. 16

35

| 2ND CHARACTERISTIC OF FEEDER | MOVING DISTANCE FROM DRUG'S DROPPING POSITION TO HOPPER COVER Lml (cm) |
|---|---|
| J1 | 20 |
| J2 | 40 |
| J3 | 60 |

FIG. 20

51

| FEEDER NO. | DRUG NAME | DRUG CHARACTERISTIC |
|---|---|---|
| 41-1, 3-1 | H | T'5 |
| 41-1, 3-2 | G | T'1 |
| 41-1, 3-3 | E | T'4 |
| 41-1, 3-4 | B | T'5 |
| 41-1, 3-5 | A | T'6 |
| 41-1, 3-6 | I | T'2 |
| 41-2, 3-1 | J | T'2 |
| ⋮ | ⋮ | ⋮ |
| 42-3, 3-1 | P | T'2 |
| 42-3, 3-2 | Q | T'2 |
| 42-3, 3-3 | R | T'4 |
| ⋮ | ⋮ | ⋮ |
| 43-1, 3-1 | X | T'3 |
| 43-1, 3-2 | Y | T'4 |
| 43-1, 3-3 | Z | T'5 |
| ⋮ | ⋮ | ⋮ |

FIG. 21

52

| FEEDER NO. | 1ST CHARACTERISTIC OF FEEDER | 2ND CHARACTERISTIC OF FEEDER | 3RD CHARACTERISTIC OF FEEDER |
|---|---|---|---|
| 41-1, 3-1 | H1 | I3 | K4 |
| 41-1, 3-2 | H2 | I3 | K4 |
| 41-1, 3-3 | H3 | I3 | K4 |
| 41-1, 3-4 | H4 | I3 | K4 |
| 41-1, 3-5 | H5 | I3 | K4 |
| 41-1, 3-6 | H6 | I3 | K4 |
| 41-2, 3-1 | H1 | I3 | K3 |
| ⋮ | ⋮ | ⋮ | ⋮ |
| 42-3, 3-1 | H1 | I2 | K2 |
| 42-3, 3-2 | H2 | I2 | K2 |
| 42-3, 3-3 | H3 | I2 | K2 |
| ⋮ | ⋮ | ⋮ | ⋮ |
| 43-1, 3-1 | H1 | I1 | K4 |
| 43-1, 3-2 | H2 | I1 | K4 |
| 43-1, 3-3 | H3 | I1 | K4 |
| ⋮ | ⋮ | ⋮ | ⋮ |

FIG. 22

53

| 2ND CHARACTERISTIC OF FEEDER | MOVING DISTANCE FROM DRUG'S DROPPING POSITION TO BELT CONVEYOR Lm2 (cm) |
|---|---|
| I1 | 10 |
| I2 | 20 |
| I3 | 30 |

FIG. 23

54

| 3rd Characteristic of feeder | Carrying time by belt conveyor th (sec) |
|---|---|
| $K_1$ | 0. 2 |
| $K_2$ | 0. 4 |
| $K_3$ | 0. 6 |
| $K_4$ | 0. 8 |

DRUG PACKING APPARATUS

BACKGROUND OF THE INVENTION

This invention relates to a drug packing apparatus for selecting a designated kind of drugs from among a plurality of different kinds of drugs (such as tablets, capsules, vials and ampules) and packing the thus selected drugs in a pouch.

Japanese Utility Model Publication 1-8482 discloses a drug packing apparatus of this type, called a "tablet packer". This tablet packer has a plurality of tablet cases in which are stored different kinds of tablets. The tablet cases are classified into a plurality of groups according to the distance between the tablet packing position and each tablet case. For each group, the time required for tablets discharged from each case to drop into a packing sheet is determined beforehand. When tablets are discharged from one of the tablet cases, they are packed after the required time determined for the group to which this case belongs has passed. Thus, it is possible to pack tablets discharged from tablet cases with no waste of time.

It takes a long time for tablets to be discharged from a tablet case that is located far from the tablet packing position. While these tablets are being fed toward the tablet packing position, it is impossible to discharge tablets for the next lot. The packing efficiency is thus low.

An object of the present invention is to provide a drug packing apparatus which can pack tablets efficiently irrespective of the distance between the drug packing position and the positions where drugs (such as tablets, capsules, vials or ampules) are stored.

SUMMARY OF THE INVENTION

According to the present invention, there is provided a drug packing apparatus comprising a hopper, and a plurality of feeders provided over the hopper for holding different kinds of drugs. The feeders are adapted to drop drugs into the hopper. The drugs are discharged from the hopper through a discharge hole formed in the hopper to pack the drugs. The apparatus is characterized in that the apparatus further comprises a hopper opening means for opening and closing the discharge hole of the hopper, at least one intermediate drug stopper for temporarily stopping the drugs discharged from the feeders and them dropping them into the hopper, and a control means for controlling the feeders. The intermediate drug stopper and the hopper opening means to drop drugs from the feeders onto the intermediate drug stopper, to hold the drugs temporarily on the intermediate stopper, to drop the drugs from the intermediate drug stopper onto the hopper, to hold the drugs on the hopper opening means, and to open the hopper opening means, thereby discharging the drugs through the hopper opening means, the control means being adapted to compare the time period taken for each drug to drop from the each feeder onto the intermediate drug stopper with the time period taken for each drug to drop from the intermediate drug stopper onto the hopper opening means, and to activate the intermediate drug stopper and the hopper opening means simultaneously when the longer one of the two time periods has passed to drop the drugs on the intermediate drug stopper and the hopper opening means.

According to the present invention, drugs dropped from the respective feeders are stopped by the intermediate drug stopper and then dropped onto the hopper. The control means compares the time taken for each drug to drop from each feeder onto the intermediate drug stopper and the time taken for each drug to drop from the intermediate drug stopper onto the hopper opening means. When the longer one of these two time periods has passed, the control unit activates the intermediate drug stopper and the hopper opening means simultaneously to drop the drugs on the intermediate drug stopper and the drugs flow through the discharge hole of the hopper. This means that the drugs on the intermediate drug stopper are dropped simultaneously when dropping drugs from a predetermined feeder onto the intermediate drug stopper. Thus, drugs can be packed efficiently even if some feeders are located rather far from the discharge hole of the hopper. The next operations are started after both of these two operations are finished.

Other features and objects of the present invention will become apparent from the following description made with reference to the accompanying drawings, in which:

BRIEF DESCRIPTION OF THE DRAWINGS

FIG. 4 is a view of a drug storage data table stored in the memory of the first embodiment;

FIG. 5 is a view of a drug type data table stored in the same memory;

FIG. 6 is a view of a feeder type searching data table stored in the same memory;

FIG. 7 is a view of a data table of first feeder categories stored in the same memory;

FIG. 10 is a view showing the data collected by the processor of the first embodiment;

FIG. 11A–11E are views showing the control data table in the processor of the first embodiment;

FIG. 13 is a view showing a drug storage data table stored in the memory of the second embodiment;

FIG. 14 is a view showing a drug type data table stored in the same memory;

FIG. 15 is a view showing a feeder type searching data table stored in the same memory;

FIG. 16 is a view of a data table of second feeder categories stored in the same memory;

FIG. 20 is a view showing a drug storage data table stored in the memory of the third embodiment;

FIG. 21 is a view showing a feeder type searching data table stored in the same memory;

FIG. 22 is a view of a data table of second feeder categories stored in the same memory; and FIG. 23 is a view of a data table of third feeder categories stored in the same memory.

DETAILED DESCRIPTION OF THE PREFERRED EMBODIMENT

Figure 1:
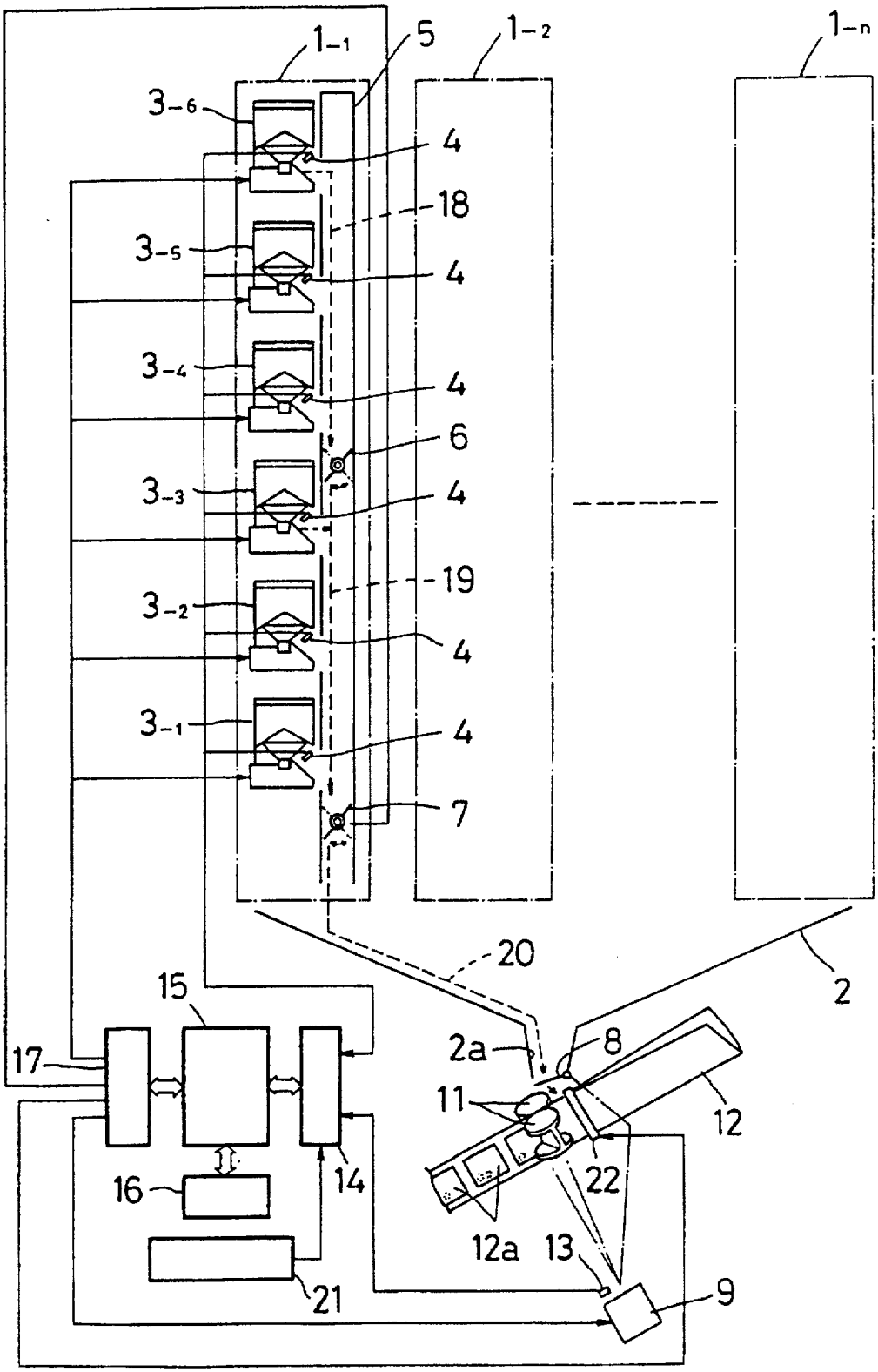
FIG. 1 is a schematic view of a first embodiment of the drug packing apparatus according to the present invention.

Now with reference to the drawing figures, the embodiments of the present invention will be described.

Figure 2:
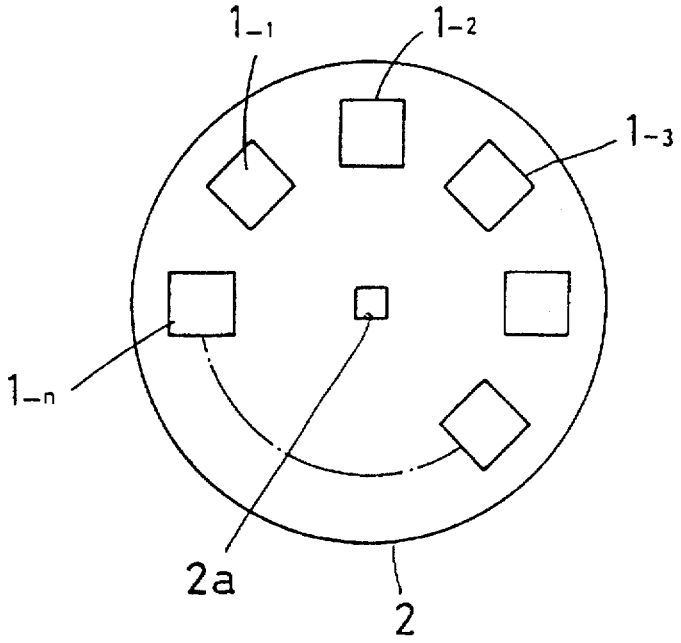
FIG. 2 is a schematic top plan view of the first embodiment.

FIG. 1 schematically shows a first embodiment of the drug packing device in this invention. In FIG. 1, a plurality of feeder units $1_{-1}$ to $1_{-n}$ are arranged over a funnel-shaped hopper 2 which has a discharge hole 2*a* at its center. As shown in FIG. 2, the feeder units $1_{-1}$ to $1_{-n}$ are provided along the circumferential edge of the hopper 2 so as to be spaced the same distance from the discharge hole 2*a*.

Six feeders $3_{-1}$ to $3_{-6}$ are mounted one over another in each of the feeder units $1_{-1}$ to $1_{-n}$. The feeders $3_{-1}$ to $3_{-6}$ contain different types of drugs. Drugs are discharged one by one from the feeders $3_{-1}$ to $3_{-6}$. Also, each of the feeders $3_{-1}$ to $3_{-6}$ is provided with a drug sensor 4 for detecting drugs discharged from the feeders. Each drug sensor 4 comprises e.g. a light-emitting element and a light-receiving element arranged oppositely, between which the drug passes and is detected.

In each of the feeder units $1_{-1}$ to $1_{-n}$ a cylinder 5 is mounted and drugs discharged from the feeders $3_{-1}$ to $3_{-6}$ drop through the cylinders. A first shutter 6 and a second shutter 7 are provided inside the cylinder 5 and are pivoted by actuators (not shown). By this pivoting, the cylinder 5 is opened near its vertical center and near its bottom.

Figure 3:
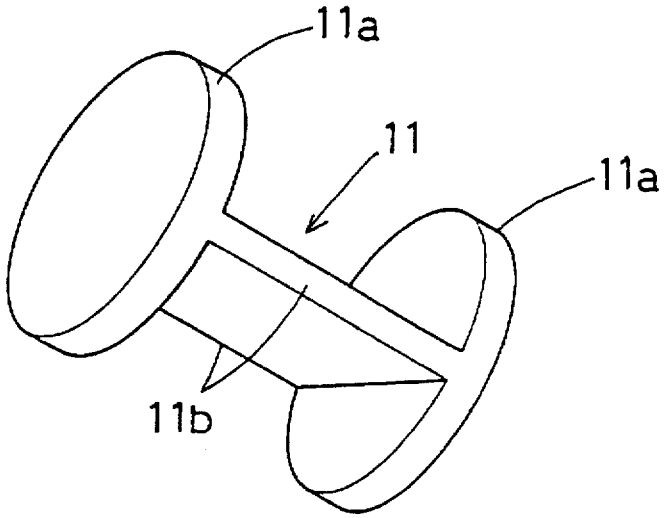
FIG. 3 is a perspective view of a heater roller of the first embodiment.

A hopper cover 8 is pivotably supported to close the discharge hole 2*a* at the bottom of the hopper 2. A motor 9 is provided to pivot the hopper cover 8 through a transmission mechanism (not shown) to open and close the discharge hole 2*a*. A pair of heater rollers 11 in the shape of a cylinder partially cut off as shown in FIG. 3 are provided under the hopper cover 8. Edges of the top and bottom circular plates 11*a* and of the flat center plate 11*b* generate heat. The motor 9 rotates the heater rollers 11 in opposite directions through a transmission mechanism (not shown). Between the heater rollers 11 is sandwiched a packing sheet 12 folded at its longitudinal center. The packing sheet 12 is fed by the rotation of the heater rollers 11. A thermosensitive adhesive is applied on opposing inner surfaces of the packing sheet 12 so that they are partially heated by the edges of the heater rollers 11 and bonded together. In this manner, packing bags 12*a* are formed one after another.

The hopper cover 8 of the hopper 2 and the heater rollers 11 are driven synchronously by the motor 9. In this embodiment, one packing bag 12*a* is formed by every half rotation of the heater rollers 11. During the rotation, after the packing sheet 12 has been sandwiched between the edges 11*b* of the heater rollers 11 with its longitudinal edges sealed, the hopper cover 8 is opened, and is closed again after a preset period of time. When the hopper cover 8 is closed, the heater rollers 11 reach the reference position, which is detected by a reference position sensor 13, and a packing bag 12*a* is now made. An encoder may be used as the reference position sensor 13.

Outputs from the drug sensors 4 in the feeders and from the reference position sensor 13 for the heater rollers 11 are sent to an operation control unit 15 through an input unit 14. The operation control unit 15 controls each feeder 3, the first shutter 6, the second shutter 7 and the motor 9 through an output unit 17 based on the outputs from the sensors and the data kept in a memory unit 16 in a manner which will be described later in detail.

The operation control unit 15 controls, for example, the feeder $3_{-6}$ in the feeder unit $1_{-1}$ to activate and discharge a drug. The drug drops through cylinder 5 and stops at the first shutter 6, as shown by a dotted arrow 18 in FIG. 1. When the first shutter 6 opens, the drug is dropped further to the second shutter 7, as shown by a dotted arrow 19, and stopped. By opening the second shutter 7, the drug falls down onto the hopper 2 as shown by dotted arrow 20 and slides and rolls along the inner wall of the hopper 2 until it reaches and stops at the discharge hole 2*a*. When the hopper cover 8 opens thereafter, the drug is dropped into the packing sheet 12, which is now folded in two. Then, the heater rollers 11 make a half turn so as to form one packing bag 12*a* with the drug sealed therein. This operation is repeated to pack drugs one after another.

A drug designation unit 21 is controlled by an operator. Prescription data such as drug names, number of drugs to be taken at a time, and the number of times the drugs are taken per day are inputted in the operation control unit 15 from the drug designation unit 21 through the input unit 14. They are recorded in the memory unit 16.

When one prescription is specified by the drug designation unit 21, the operation control unit 15 reads its data out from the memory unit 16. Then, the operation control unit 15 starts its operation for packing the prescribed drugs. Meanwhile, a printing unit 22 is controlled by the operation control unit 15 to print the specified prescription data.

In the memory unit 16 a drug accommodation data table 23 (FIG. 4) is recorded. The table 23 keeps data such as drug names, the feeder numbers where each type of drugs is accommodated and characteristics thereof. For example, drugs H are accommodated in the feeder ($1_{-1}$, $3_{-1}$), i.e. in the feeder $3_{-1}$ in the feeder unit $1_{-1}$ and given a characteristic $T_7$.

As for the characteristic of the drugs, they are classified into seven categories $T_1$ through $T_7$ as shown in a drug characteristic data table 24 (FIG. 5) which is kept in the memory unit 16. These characteristics indicate moving time period "$t_m$", i.e. the time period starting from the moment when the drug lands on the hopper 2 to the moment when it has reached the discharge hole 2*a* of the hopper 2. As will be apparent from this data table 24, the characteristic $T_1$ defines a drum-shaped tablet having a moving time "$t_m$" of 1.9 seconds. Similarly, the characteristics $T_2$, $T_3$, $T_4$, $T_5$, $T_6$ and $T_7$ denote an elliptical tablet, an elliptical capsule, a clover-shaped tablet, a vial, an ampule and a spherical tablet having a "$t_m$" of 1.6 seconds 1.5 seconds 1.4 seconds, 1.0 second 0.8 second and 0.6 second, respectively.

When drugs of one type are ordered, the feeder number containing the ordered type of drugs and its characteristic can be confirmed from the data table 23 shown in FIG. 4. Thereafter, the data table 24 shown in FIG. 5 will give the moving time "$t_m$" of the ordered drug.

Referring to FIG. 6, a data table 25 for searching feeders' characteristics recorded in the memory unit 16 keeps data on feeder numbers and their first characteristics. The feeders' first characteristics are classified into six categories $H_1$ through $H_6$ as shown in a data table 26 (FIG. 7) recorded in the memory unit 16. As will be apparent from the table 26, the characteristics $H_1$, $H_2$ and $H_3$ are given to the feeders $3_{-1}$, $3_{-2}$ and $3_{-3}$, respectively, which are located between the first shutter 6 and the second shutter 7. Of these three feeders, the lowest feeder $3_{-1}$ is given a dropping time "$t_s$" of 0 second. For the feeders $3_{-2}$ and $3_{-3}$, placed higher than the feeder $3_{-1}$, 0.1 second is given as a dropping time "$t_s$". The remaining first characteristics $H_4$, $H_5$ and $H_6$ are given to the feeders $3_{-4}$, $3_{-5}$ and $3_{-6}$, which are located higher than the second shutter 7. Of these three feeders, the lowest feeder $3_{-4}$ is given a dropping time "$t_s$" of 0 second. For the feeders $3_{-5}$ and $3_{-6}$, placed higher than the feeder $3_{-4}$, 0.1 second is given as a dropping time "$t_s$". The dropping time "$t_s$" is the time period from the moment when the drug is discharged from the feeder to the moment it reaches the shutter. The feeders $3_{-1}$ and $3_{-4}$ which are immediately above the first and second impellers 6 and 7, respectively, have a dropping time "$t_s$" of zero second (because they have extremely short dropping time). The feeders $3_{-3}$ and $3_{-6}$, located farthest from the impellers 7 and 6, respectively, have a dropping time "$t_s$" of 0.1 second. Moreover, 0.1 second of dropping time is given to the intermediate feeders $3_{-2}$ and $3_{-5}$, too, although they actually have a shorter dropping time than the feeders $3_{-3}$ and $3_{-6}$.

Figure 8:
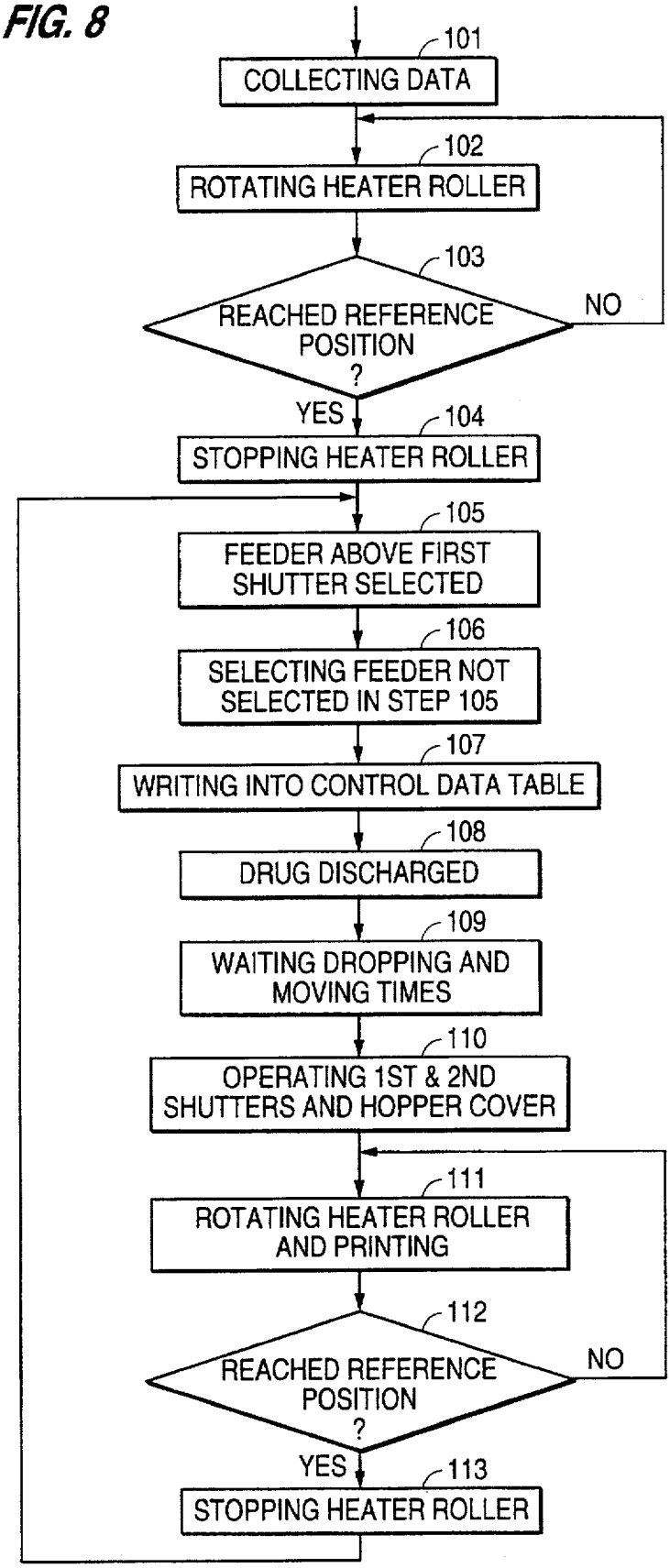
FIG. 8 is a flowchart showing the processing sequence in the first embodiment.
Figure 9:
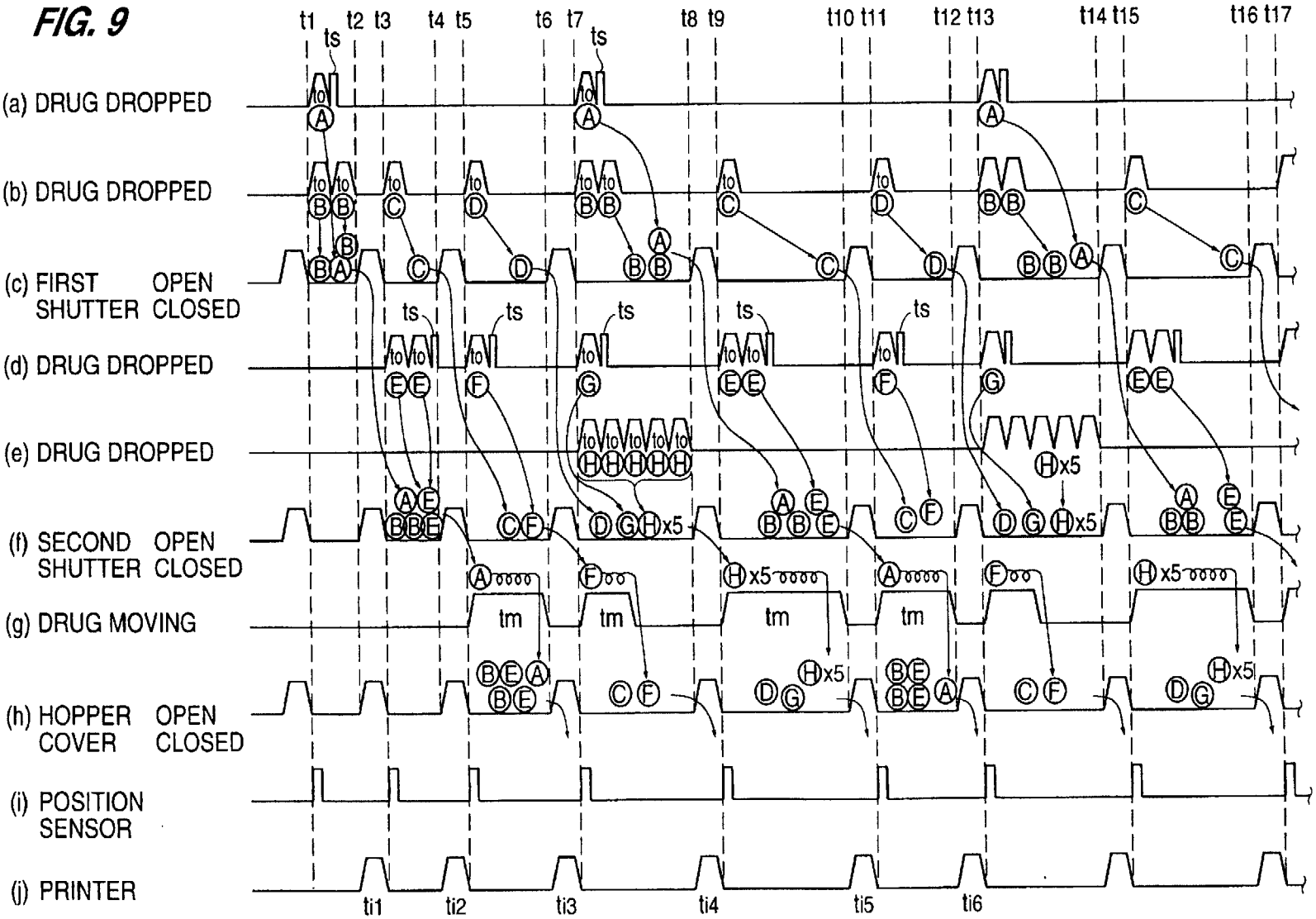
FIG. 9 is a flow chart showing processing timings of the first embodiment.

In this drug packing device, we shall explain how drugs are discharged from the feeders with reference to FIG. 8 (flow chart) and FIG. 9 (timing chart).

Time point $t_1$–$t_3$

First, the operation control unit 15 reads out a prescription from the memory unit 16 and specifies drug names and their numbers. Then, all drug names, the number of each kind of drugs to be taken at one time, and the number of times the drugs are to be taken per day are obtained based on the prescription. Also, referring to the data tables 23–26 (FIGS. 4–7) which are stored in the memory unit 16, determination is made of the feeder numbers containing the specified drugs, whether or not the selected feeders' characteristics are $H_4$–$H_6$ (higher than the first shutter 6) the dropping time "$t_s$" corresponding to the heights of the feeders and the drugs' moving time "$t_m$" on the hopper 2 (step 101 in FIG. 8).

Now, let us assume that a patient has to take drugs A, B and E in the morning. By searching the data tables 23–26, it is possible to determine the feeders ($1_{-1}$, $3_{-5}$), ($1_{-1}$, $3_{-4}$), ($1_{-1}$, $3_{-3}$) which contain the specified drugs A, B and E, respectively, whether or not these feeders are located higher than the first shutter 6, the dropping time "$t_s$" (0.1 second) (0 second) (0.1 second) and the moving time "t" (1.4 second) (1.0 second) and (1.0 second) respectively.

If drugs C and F, to be taken in the afternoon, are selected, their respective feeder numbers ($1_{-2}$, $3_{-4}$) and ($1_{-2}$, $3_{-3}$), whether these feeders are located higher than the first shutter 6, their respective dropping times "$t_s$" (0 second) and (0.1 second) and their respective moving times "$t_m$" (0.8 second) and (1.0 second) are determined.

Similarly, if drugs D, G and H, to be taken in the evening, are selected, their respective feeder numbers ($1_{-3}$, $3_{-4}$), ($1_{-1}$, $3_{-2}$) and ($1_{-1}$, $3_{-1}$) whether or not these feeders are located higher than the first shutter 6, their respective dropping times "$t_s$" (0 second), (0.1 second) and (0 second) and their respective moving times "$t_m$" (1.9 seconds), (0.8 second) and (0.6 second) are determined.

These data are collected and organized in the operation control unit 15 as shown in FIG. 10.

The operation control unit 15 activates the motor 9 so as to rotate the heater rollers 11 and feed the packing sheet 12 (step 102 in FIG. 8). During this time, the operation control unit 15 judges whether or not the heater rollers 11 have reached the reference position based upon the detected output from the reference position sensor 13 (step 103). When the output of the reference position sensor 13 becomes high level at time t1 shown in FIG. 9 at (e), the operation control unit 15 judges that the heater rollers 11 have reached the reference position (step 103, Yes) and stops the motor 9 (step 104).

Next, with reference to the data shown in FIG. 10, the operation control unit 15 selects from amono the drugs A, B and E (taken in the morning) the drugs A and B, i.e. the drugs in the feeders ($1_{-1}$, $3_{-5}$) and ($1_{-1}$, $3_{-4}$) which belong in the first characteristics $H_4$–$H_6$, that is, the feeders located higher than the first shutter 6 (step 105 in FIG. 8).

The operation control unit 15 records the drug names A and B into a control data table 27 as shown in FIG. 11A (step 107).

Also, the operation control unit 15 instructs one of the selected feeders ($1_{-1}$, $3_{-5}$) (the feeder $3_{-5}$ in the feeder unit $1_{-1}$) to discharge one drug (step 108 in FIG. 8). In response to this, the feeder $3_{-5}$ is activated to discharge one drug A. The drug A is dropped to the first shutter 6.

It takes a discharging time of "$t_0$" to discharge one drug from this feeder as shown in FIG. 9 at (a). When the drug A is discharged, the drug sensor 4 in the feeder $3_{-5}$ detects this single drug and supplies the output to the operation control unit 15. Thus, as soon as the discharging time "$t_0$" has lapsed, the operation control unit 15 can confirm that one drug A has been discharged by checking the fact that only one output has been sent from the drug sensor 4.

The operation control unit 15 waits for a dropping time "$t_s$" of 0.1 second preset for the feeder $3_{-5}$ as shown in FIG. 9 at (a) (step 109 in FIG. 8).

In the same manner, the operation control unit 15 instructs the other feeder ($1_{-1}$, $3_{-4}$) to discharge two drugs B (step 108). The feeder $3_{-4}$ is activated twice to discharge two drugs B. The drugs B also reach the first shutter 6.

As shown in FIG. 9 at (b), the discharging time is twice the time "$t_0$" in this case because the feeder $3_{-4}$ is activated twice to discharge two drugs. The operation control unit 15 receives two outputs from the drug sensor 4 and confirms that two drugs B are discharged. As the dropping time "$t_s$" of the feeder $3_{-4}$ is zero second, the step 109 in FIG. 8 is skipped.

As will be apparent from (a) and (b) in FIG. 9, of these drugs, i.e. one drug A and two drugs B, the drug B discharged later is the last to reach the first shutter 6. On receiving the second output from the drug sensor 4 in the feeder ($1_{-1}$, $3_{-4}$) at the time point t2, the operation control unit 15 selectively opens and closes the first shutter 6, the second shutter 7 and the hopper cover 8 (step 110). Thus, the drugs A and B on the first shutter 6 are dropped together to the second shutter 7.

On the other hand, the operation control unit 15 obtains inspection items of the drugs to be printed on labels, such as drug names, their respective numbers, total number, etc. At the time point $t_2$, the operation control unit 15 transmits the inspection items to the printing unit 22. From this point, the hopper cover 8 and the heater rollers 11 are activated to feed the packing sheet 12. On receiving the inspection items, the printing unit 22 prints these data on the packing sheet 12 during the time period $t_{i1}$ shown in FIG. 9 at (j). In other words, the inspection items are printed on the packing sheet while it is being fed (step 111 in FIG. 8).

Next, when the output from the reference position sensor 13 becomes high at the time point $t_3$ as shown in FIG. 9 at (i), the operation control unit 15 judges, that the heater rollers 11 have reached the reference position (step 112, Yes) and stops the motor 9 (step 113).

In normal cases, in the step 106, feeders and their drug names which have not been selected in the step 105 during the previous cycle are now selected; in the step 108, the thus selected drugs are ordered to be discharged. However, since the aforementioned cycle is the first one and there is no "previous cycle", these steps are omitted here.

Time point $t_3$–$t_5$

Next, with reference to the data shown in FIG. 100 the operation control unit 15 selects from the drugs C and F (taken in the afternoon) drug C i.e. the drug in the feeder ($1_{-2}$, $3_{-4}$) which belongs in the first characteristics $H_4$–$H_6$, that is, the feeder located higher than the first shutter 6 (step 105 in FIG. 8).

The operation control unit 15 also selects the drug E and its feeder ($1_{-1}$, $3_{-3}$) which was not selected in the step 105 during the previous cycle (step 106). Namely, the control unit 15 selects the drug E (to be taken in the morning) which was not selected during the previous cycle and which is stored in, the feeder ($1_{-1}$, $3_{-3}$) located between the first shutter 6 and the second shutter 7.

As shown in FIG. 11B, the operation control unit 15 renews the control data table 27 by recording the drug C selected in the step 105 and the drug E selected in the step 106 (step 107 in FIG. 8).

Next, the operation control unit 15 controls discharge of drugs from the feeders ($1_{-2}$, $3_{-4}$) and ($1_{-1}$, $3_{-3}$).

Namely, the operation control unit 15 instructs the feeder ($1_{-2}$, $3_{-4}$) to discharge one drug (step 108). In response, the feeder $3_{-4}$ in the feeder unit $1_{-2}$ discharges one drug C as shown in FIG. 9 at (b). The drug now reaches the first shutter 6.

Also, the operation control unit 15 instructs the feeder ($1_{-1}$, $3_{-3}$) to discharge two drugs (step 108). In response, the feeder $3_{-3}$ in the feeder unit $1_{-1}$ discharges two drugs E as shown in FIG. 9 at (d). These drugs reach the second shutter 7 and are kept in this position together with the drugs A, B which have been dropped during the previous cycle.

After two drugs have been discharged from the feeder ($1_{-1}$, $3_{-3}$), the operation control unit 15 waits for the dropping time "$t_s$" (0.1 second) preset for the feeder $3_{-3}$ (step 109) (d) in FIG. 9.

As will be apparent from (b) and (d) in FIG. 9, of the drugs C and E, the second drug E is the last one to reach the second shutter 9.

After the operation control unit 15 receives the second output from the drug sensor 4 in the feeder ($1_{-1}$, $3_{-3}$) and after the dropping time "$t_s$" of 0.1 second has lapsed, i.e. at the time point t4, it selectively opens and closes the first shutter 6, the second shutter 7 and the hopper cover 8 (step 110) to drop the drug C on the first shutter 6 onto the second shutter 7 and the drugs A, B and E on the second shutter 7 onto the hopper 2.

Referring to the data shown in FIG. 10, the operation control unit 15 obtains printing data for directing a patient to take the drugs in the morning. These data are transmitted to the printing unit 22, which prints them on the packing paper 12 at the time period $t_{i2}$ shown in FIG. 9 at (f) (step 111 in FIG. 8).

When the printing is finished, the preceding portion of the packing sheet 12, on which the inspection items have been printed (step 111 during the previous cycle), is fed forward through the heater rollers 11. Thus, an empty packing bag 12*a* indicating the inspection items, such as all drug names, their respective numbers, the total number, etc., is now finished.

If the detected output from the reference sensor 13 becomes high, the operation control unit 15 judges that the heater rollers 11 have reached the reference position (time point $t_5$ shown in FIG. 9 at (i)) (step 112, Yes in FIG. 8). Thus, the operation control unit 15 stops the motor 9 (step 113).

Time point $t_5$–$t_7$

Next, with reference to the data shown in FIG. 10, the operation control unit 15 selects from the drugs D, G and H (taken in the evening) the drug D, i.e., the drug in the feeder ($1_{-3,\ 3-4}$) which belongs in the first characteristics $H_4$–$H_6$, that is, the feeder located higher than the first shutter 6 (step 105 in FIG. 8).

The operation control unit 15 also selects the drug F and its feeder ($1-_2$, $3-_3$) which was not selected in the step 105 during the previous cycle (step 106). Namely, the control unit 15 selects the drug stored in the feeder located between the first shutter 6 and the second shutter 7.

As shown in FIG. 11C, the operation control unit 15 renews the control data table 27 by recording the drug D selected in the step 105 and the drug F selected in the step 106 (step 107 in FIG. 8).

Next, the operation control unit 15 controls discharge of drugs from the feeders ($1_{-3}$, $3-_4$) and ($1-_2$, $3-_3$).

Namely, the operation control unit 15 instructs the feeder ($1_{-3}$, $3-_4$) to discharge one drug (step 108). In response, the feeder $3-_4$ in the feeder unit $1_{-3}$ discharges one drug D as shown in FIG. 9 at (b). The drug reaches the first shutter 6.

Also, the operation control unit 15 instructs the feeder ($1-_2$, $3-_3$) to discharge one drug (step 108). In response, the feeder $3-_3$ in the feeder unit $1-_2$ discharges one drug F as shown by (d) in FIG. 9. This drug reaches the second shutter 7 and is kept in this position together with the drug C which has been dropped during the previous cycle.

Further, as shown in FIG. 9 at (d), the operation control unit 15 waits for the dropping time "$t_s$" (0.1 second) preset for the feeder $3-_3$ (step 109).

The operation control unit 15 obtains the moving times "$t_m$" for the drugs A, B and E which have been dropped on the hopper 2 by the rotation of the second shutter 7 in the step 110 during the previous step (1.4 seconds), (1.0 second) and (1.0 second), respectively, referring to the table shown in FIG. 10. The operation control unit 15 then selects and waits for the longest moving time of the drug A, i.e., 1.4 seconds, from the time point $t_5$ (step 109 in FIG. 8).

As shown at (b), (d) and (g) in FIG. 9, of the drugs D and F discharged from the feeders and the drugs A, B and E dropped from the second shutter, the drug A requires the longest time and thus is the last one to land on the hopper cover 8 of the hopper 2.

For this reason, the operation control unit 15 opens and closes the first shutter 6, the second shutter 7 and the hopper cover 8 at the time point t6, which is 1.4 seconds from the time point $t_5$ (detecting the reference position) (step 110 in FIG. 8). Thus, the drug D is dropped from the first shutter 6 to the second shutter 7, and the drugs C and F from the second shutter 7 to the hopper 2. Also, the drugs A, B and E are dropped from the hopper cover 8 into the packing sheet 12.

In the meantime, the operation control unit 15 rotates the heater rollers 11 to pack the drugs A, B and E in a packing bag 12*a* (step 111). The packing bag 12*a* carries taking directions printed in the step 111 during the second cycle, which direct the patient to take the drugs contained therein in the morning.

With reference to the data shown in FIG. 10, after the operation control unit 15 has obtained at the time point t6 the information that the drugs should be taken in the afternoon, it transmits it to the printing unit 22. The printing unit 22 prints it on the packing sheet at the point $t_{i3}$ shown at (j) in FIG. 9 (step 111 in FIG. 8).

When the output of the reference position sensor 13 becomes high level at the point $t_7$ in (i) shown in FIG. 9, the operation control unit 15 judges that the heater rollers 11 have reached the reference position (step 112, Yes) and stops the motor 9 (step 113).

Time point $t_7$–$t_9$

Next, referring to the data shown in FIG. 10, the operation control unit 15 selects from the drugs A', B' and E' (taken in the morning) the drugs A' and B' i.e. the drugs in the feeders ($1_{-1}$, $3_{-5}$) and ($1_{-1}$, $3_{-4}$), which are located higher than the first shutter 6 (step 105 in FIG. 8).

The operation control unit 15 also selects the drugs G and H to be taken in the evening contained in the feeders ($1_{-1}$, $3_{-2}$) and ($1_{-1}$, $3_{-1}$). These drugs were not selected in the step 105 during the previous cycle (step 106). Namely, the control unit 15 selects the drugs in the feeders located between the first and second impellers 6 and 7.

As shown in FIG. 11D, the operation control unit 15 renews the control data table 27 by recording the drugs A' and B' selected in the step 105 and the drugs G and H selected in the step 106 (step 107 in FIG. 8).

Next, the operation control unit 15 controls discharge of the drugs from the feeders ($1_{-1}$, $3_{-5}$), ($1_{-1}$, $3_{-4}$), ($1_{-1}$, $3_{-2}$) and ($1_{-1}$, $3_{-1}$).

Namely, the operation control unit 15 instructs the feeder ($1_{-1}$, $3_{-5}$) to discharge one drug (step 108). In response, the feeder $3_{-5}$ in the feeder unit $1_{-1}$, discharges one drug A' as shown by (a) in FIG. 9. The drug now reaches the first shutter 6.

The operation control unit 15 also commands the feeder ($1_{-1}$, $3_{-4}$) to discharge two drugs (step 108) and two drugs B' are discharged from the feeder $3_{-4}$ in the feeder unit $1_{-1}$ as shown at (b) in FIG. 9. These drugs reach the first shutter 6, too.

Also, the operation control unit 15 instructs the feeder ($1_{-1}$, $3_{-2}$) to discharge one drug (step 108 in FIG. 8) and one drug G is discharged therefrom as shown at (d) in FIG. 9. This drug reaches the second shutter 7.

Further, the operation control unit 15 orders the feeder ($1_{-1}$, $3_{-1}$) to discharge five drugs (step 108). The feeder $3_{-1}$ in the feeder unit $1_{-1}$ then discharges five drugs H as shown by (e) in FIG. 9. The drugs reach the second shutter 7.

Now, the drugs G and H are kept in this position together with the drug D which have been dropped to the second shutter 7 during the previous cycle.

After one drug A' has been discharged from the feeder, the operation control unit 15 waits for the dropping time "$t_s$" (0.1 second) preset for the feeder $3_{-5}$ (step 109 in FIG. 8) ((d) in FIG. 9). Similarly, after one drug G has been discharged from the feeder, the operation control unit 15 waits for the dropping time "$t_s$" (0.1 second) preset for the feeder $3_{-2}$ (step 109) ((d) in FIG. 9).

The operation control unit 15 obtains the moving times "$t_m$" for the drugs C and F which were dropped on the hopper 2 by the rotation of the second shutter 7 in the step 107 during the previous cycle (0.8 second) and (1.0 second), respectively, referring to the table shown in FIG. 10. From the time point $t_7$, the operation control unit 15 selects and waits for the longest moving time "$t_m$" of the drug F, i.e. 1.0 second (step 109 in FIG. 8). The time point $t_7$ is the time when the reference position of the heater rollers 11 was detected in the step 112 during the previous cycle.

Of the drugs A', B', G and H discharged from the feeders and the drugs C and F dropped to the hopper 2 (from the time point $t_7$ to the time point $t_8$), the fifth drug H is the last one to reach the second shutter 7 as shown in (a), (b), (d), (e) and (g).

When the operation control unit 15 receives the fifth output from the drug sensor 4 in the feeder ($1_{-1}$, $3_{-1}$), i.e. at the time point $t_8$, it opens and closes the first shutter 6, the second shutter 7 and the hopper cover 8 (step 110 in FIG. 8). The drugs A' and B' on the first shutter 6 are dropped to the second shutter 7. At the same time, the drugs D, G and H on the second shutter 7 fall onto the hopper 2. Further, the drugs C and F are dropped from the hopper cover 8 of the hopper 2 into the packing sheet 12 and sealed in another packing bag **12*a***.

On the packing bag **12*a* containing the drugs C and F is indicated that the drugs should be taken in the afternoon. This information was printed in the step 111** during the third cycle.

On the other hand, at the time point $t_8$, the operation control unit 15 obtains print data for directing the patient to take the drugs in the evening by referring to the data shown in FIG. 10. The print data are transmitted to the printing unit 22, which prints them on the packing paper 12 at the time period $t_{i4}$ shown at (j) in FIG. 9 (step 111 in FIG. 8).

Time point $_9$–$t_{11}$

Next, with reference to the data shown in FIG. 10, the operation control unit 15 selects from the drugs C' and F' (taken in the afternoon) the drug C' i.e. the drug in the feeder ($1_{-2}$, $3_{-4}$) which belongs in the first characteristics $H_4$–$H_6$ and located higher than the first shutter 6 (step 105).

The operation control unit 15 also selects the drug E' and its feeder ($1_{-1}$, $3_{-3}$) which was not selected in the step 105 during the previous cycle (step 106). Namely, the control unit 15 selects the drug (to be taken in the morning) in the feeder located between the first and second impellers 6 and 7.

As shown in FIG. 11E, the operation control unit 15 renews the control data table 27 by recording the drug C' selected in the step 105 and the drug E' selected in the step 106 (step 107 in FIG. 8).

Next, the operation control unit 15 controls discharge of the drugs from the feeders ($1_{-2}$, $3_{-4}$) and ($1_{-1}$, $3_{-3}$).

Namely, the operation control unit 15 instructs the feeder ($1_{-2}$, $3_{-4}$) to discharge one drug (step 108). In response, the feeder $3_{-4}$ in the feeder unit $1_{-2}$, discharges one drug C' as shown by (b) in FIG. 9. The drug reaches the first shutter 6.

Also, the operation control unit 15 instructs the feeder ($1_{-1}$, $3_{-3}$) to discharge two drugs (step 108). The feeder $3_{-3}$ in the feeder unit $1_{-1}$ discharges two drugs E as shown by (d) in FIG. 9. These drugs reach the second shutter 7 and are kept in this position together with the drugs A', B' which have been dropped during the previous cycle.

After two drugs have been discharged from the feeder ($1_{-1}$, $3_{-3}$), the operation control unit 15 waits for the dropping time "$t_s$" (0.1 second) preset for the feeder $3_{-3}$ (step 109) ((d) in FIG. 9).

The operation control unit 15 obtains the moving times "$t_m$" for the drugs D G and H (1.9 seconds) (0.8 second) and (0.6 second), respectively, with reference to the data shown in FIG. 10. These drugs were dropped on the hopper 2 by the rotation of the second shutter 7 in the step 110 during the previous cycle. The operation control unit 15 then selects and waits for the longest moving time "$t_m$" of the drug F (1.9 seconds) from the time point $t_9$ (step 109 in FIG. 8) (the time when the reference position of the heater rollers was detected).

As will be apparent from (b), (d) and (g) in FIG. 9, of the drugs C' and E' discharged from the feeders and the drugs D, G and H dropped from the hopper, the fifth one of the drugs H is the last one to reach the hopper cover 8 of the hopper 2.

From the time point $t_9$, the operation control unit 15 waits for the longest moving time "$t_m$" (1.9 sec) and m selectively opens and closes the first and second impellers 6 and 7 and the hopper cover 8 (step 110 in FIG. 8). The drug C' on the first shutter 6 is dropped to the second shutter 7 and the drugs A', B' and E' fall down from the second shutter 7 to the hopper 2. The drugs D, G and H are dropped into the packing sheet 12 and sealed in another packing bag 12.

On the packing bag 12*a*, containing the drugs D, G and H, it is indicated that the drugs should be taken in the evening. This information was printed in the step 111 during the fourth cycle.

On the other hand, at the time point $t_{10}$, the operation control unit 15 obtains taking directions notifying the patient that the drugs should be taken in the morning with reference to the data shown in FIG. 10. These data are transmitted to the printing unit 22, which prints them on the packing paper 12 at the time period $t_{i5}$ shown by (f) in FIG. 9 (step 111 in FIG. 8).

In the same manner, the drugs A, B and E to be taken in the morning, the drugs C and F to be taken in the afternoon and the drugs D, G and H to be taken in the evening are repeatedly packed in the packing bags. When all of the prescribed drugs are packed, the operation control unit 15 terminates packing.

In the first embodiment, the process in which the drugs are dropped from the feeders to the first shutter, the process in which the drugs are dropped from the feeders to the second shutter and the process in which the drugs move along the inner wall of the hopper to the hopper cover 8 are carried out simultaneously. Thus, even if the distance between the feeder to the hopper cover 8 is long, the drugs can be packed effectively.

The first packing bag is empty and the inspection items such as the drug names and total number of each drug are printed thereon. After this empty bag, the packing bags for mornings, afternoons and evenings follow alternately. On these packing bags are printed taking directions notifying the patient that the drugs should be taken in the morning, afternoon and evening, respectively. After the drug names and the total number of each kind of drugs are inspected by checking the first empty packing bag, the first bag is detached. All the other bags containing drugs are handed to the patient. As the bags for mornings, afternoons and evenings are joined together and alternately arranged, it is easy for the patient to take the drugs.

Figure 12:
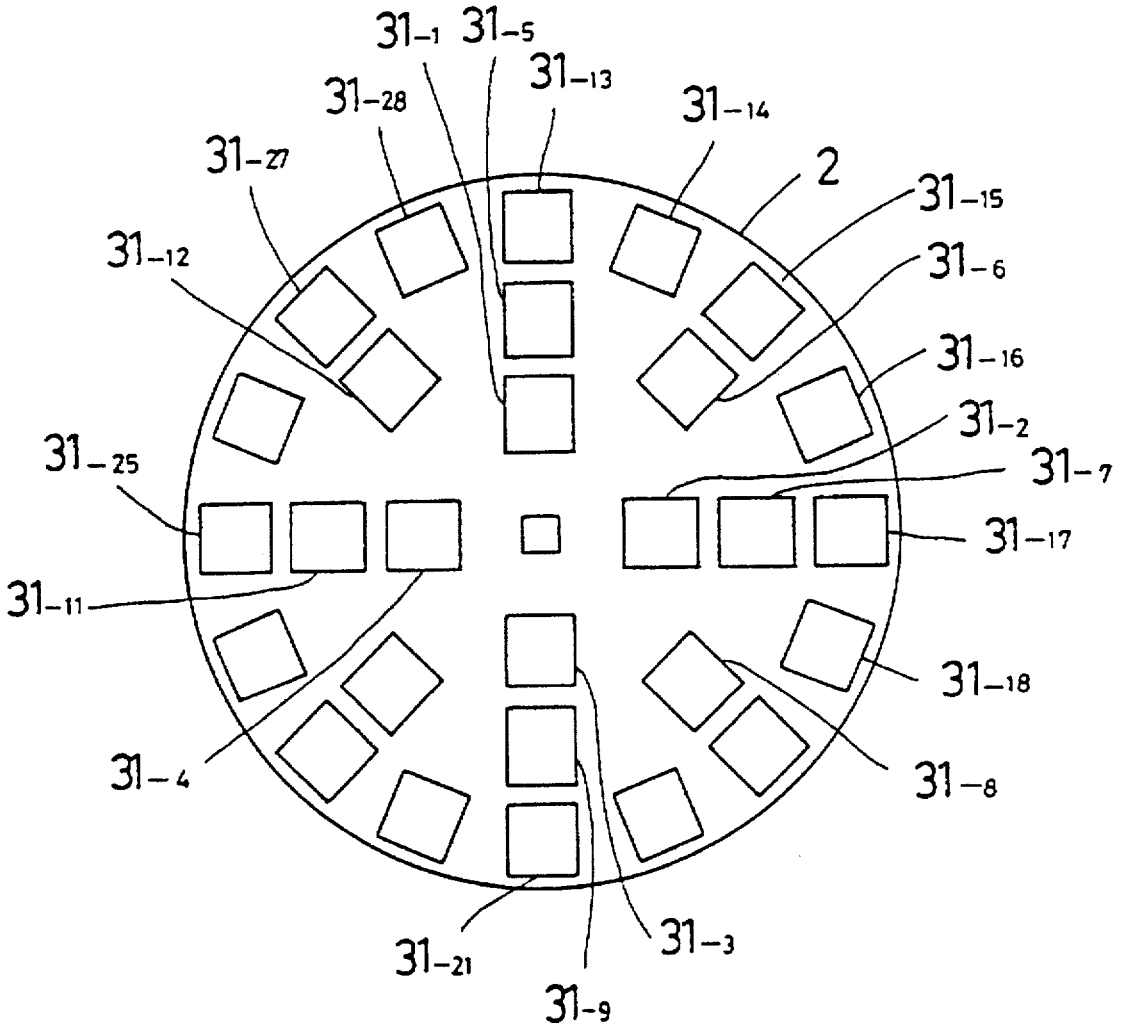
FIG. 12 is a schematic view of a second embodiment of the drug packing apparatus according to the present invention.

FIG. 12 shows a second embodiment of the present invention, in which instead of the feeder units $1_{-1}$ to $1_{-n}$, a plurality of feeder units $31_{-1}$ to $31_{-28}$ are arranged concentrically with and over the hopper 2. From center to circumference, four feeder units $31_{-1}$ to $31_{-4}$, eight feeder units $31_{-5}$ to $31_{-1}$ and sixteen feeder units $31_{-1}$ to $31_{-28}$ are aligned.

Each of these feeder units $31_{-1}$ through $31_{-28}$, is, as the embodiment shown in FIG. 1, provided with a sensor 4, and a cylinder 5 accommodating a first shutter 6 and a second shutter 7 therein.

In this embodiment, too, the hopper cover 8, motor 9, input unit 14, operation control unit 15, memory unit 16, output unit 17, drug designation unit 21, etc. are provided.

Let us compare the distance from the landing point of the drug to the discharge hole 2*a*. The drugs discharged from the innermost feeder units $31_{-1}$ to $31_{-4}$ take the shortest distance from their landing point to the discharge hole 2*a*. The feeder units $31_{-5}$ to $31_{-12}$ outside of the feeder units $31_{-1}$ to $31_{-4}$ have a slightly longer distance. The feeders $31_{-13}$ to $31_{-28}$, have the longest distance from their landing point to the discharge hole 2*a*. Thus, it is possible for drugs of the same type to have a different time period from the instant when they reach the hopper 2 to the instant when they get to the discharge hole 2*a* depending upon the position of the feeder unit accommodating the drug. If they are contained in any of the innermost feeder units $31_{-1}$ to $31_{-4}$, they take the shortest time period. If they are in any of the outermost feeder units, they need the longest time period. Consequently, it is impossible to determine the moving time "$t_m$" simply by the types of the drugs.

Thus, in this embodiment, firstly, the moving velocity "$v_m$" and the distance "$l_{m1}$" of each drug is obtained. The moving time "$t_m$" is then obtained by dividing "$l_{m1}$" by "$v_m$".

In this embodiment, the data table 26 containing feeders' first characteristics as shown in FIG. 7 is required. Also, a drug accommodation data table 32 (FIG. 13), a drug characteristic data table 33 (FIG. 14), a data table 34 for searching feeders' characteristics (FIG. 15) and a data table 35 containing feeders' second characteristics (FIG. 16) are needed in place of the data tables 23, 24 and 25 shown in FIGS. 4–6.

In the drug accommodation data table 32 shown in FIG. 13 drug names are recorded and their characteristics correspond to each of the feeder numbers.

In the drug characteristic data table 33 shown in FIG. 14, the characteristics $T'_1, T'_2, \ldots T'_7$ of each kind of drugs are defined. For example, the characteristic $T'_1$ is given to the drum-shaped tablet having a "$v_m$" of 27 cm/sec. Also, the characteristic $T'_2$, $T'_3$, $T'_4$, $T'_5$, $T'_6$ and $T'_7$ denote an elliptical tablet, an elliptical capsule, a clover-shaped tablet, a vial, an ampule and a spherical tablet having a "$v_m$" of 31 cm/sec, 33 cm/sec, 36 cm/sec, 57 cm/sec, 60 cm/sec and 80 cm/sec, respectively.

In the data table 34 for searching feeders' characteristics shown in FIG. 15, the first and second characteristics of the feeders are recorded according to the feeder numbers. The feeders' first characteristics $H_1$ to $H_6$ have been already discussed above and are shown in the data table 26 in FIG. 7. The feeders' first characteristics define the dropping time "$t_s$" based upon the height of the feeders $3_{-1}$ to $3_{-6}$ in the feeder units. Moreover, the second characteristics $J_1$ to $J_3$ are defined according to the position of the feeders on the hopper 2 as shown in the data table 35 in FIG. 16. In other words, the data table 35 containing the feeders' second characteristics shows the moving distance "$l_{m1}$" corresponding to the positions of the feeders, i.e. located innermost, inbetween and outermost of the hopper 2. As will be apparent from this data table 35, the characteristic $J_1$ is given to the feeders which are located innermost of the hopper 2 with the moving distance "$l_{m1}$" of 20 cm. $J_2$ is given to the feeders located outside thereof with the moving distance "$l_{ml}$" of 40 cm. $J_3$ is given to the feeders located outermost of the hopper 2 with the moving distance "$l_{m1}$" of 60 cm.

By recording the data tables 32, 33, 34 and 35 together with the data table 26 in FIG. 7 into the memory unit 13, the operation control unit 15 can collect the information similar to the data shown in FIG. 10. Accordingly, the steps can be carried out in the same manner based on the flow chart shown in FIG. 8.

For example, in the second embodiment, as the similar data to the one in FIG. 10 are collected, with reference to the data table 32 in FIG. 13 the characteristics $T'_1$ and $T'_4$ are obtained based upon the feeder number ($31_{-1}$, $3_{-2}$), ($31_{-5}$, $3_{-3}$) containing the drugs G and R. With reference to the data table 34 in FIG. 15, the first characteristics $H_2$ and $H_3$ corresponding to the feeder numbers ($31_{-1}$, $3_{-2}$) and ($31_{-5}$, $3_{-3}$) are read out. Then, the dropping time "$t_s$" of (0.1 second) and (0.1 second) corresponding to the first characteristics $H_2$ and $H_3$ are obtained with reference to the data table 26 shown in FIG. 7.

In the meantime, the moving velocities "$v_m$" are obtained as (27 cm/sec) and (36 cm/sec) corresponding to the characteristics T'1 and T'4. The second characteristics "$J_1$" and "$J_2$" are obtained based upon the feeder numbers ($31_{-1}$, $3_{-2}$) and ($31_{-5}$, $3_{-3}$) referring to the table 34 in FIG. 15. With reference to the data table 35 in FIG. 16, the moving distance "$l_{m1}$" defined by the second characteristic $J_1$ and $J_2$ are obtained as 20 cm and 40 cm, respectively.

As for the drug G, by dividing the moving distance "$l_{m1}$" of $J_1$ (20 cm) by the moving velocity "$v_m$" $T'_1$ (27 cm/sec) the moving time "$t_m$" on the hopper 2 is obtained. In the same manner, the moving time "$t_m$" of the drug R is obtained by dividing the moving distance "$l_{m1}$" of $J_2$ (40 cm) by the moving velocity "$v_m$" $T'_4$ (36 cm/sec).

As described above, by obtaining the dropping time "$t_s$" and moving time "$t_m$" for each drug, the data shown in FIG. 10 can be collected. Thus, a series of the operation shown in the flow chart (FIG. 8) can be carried out.

Figure 17:
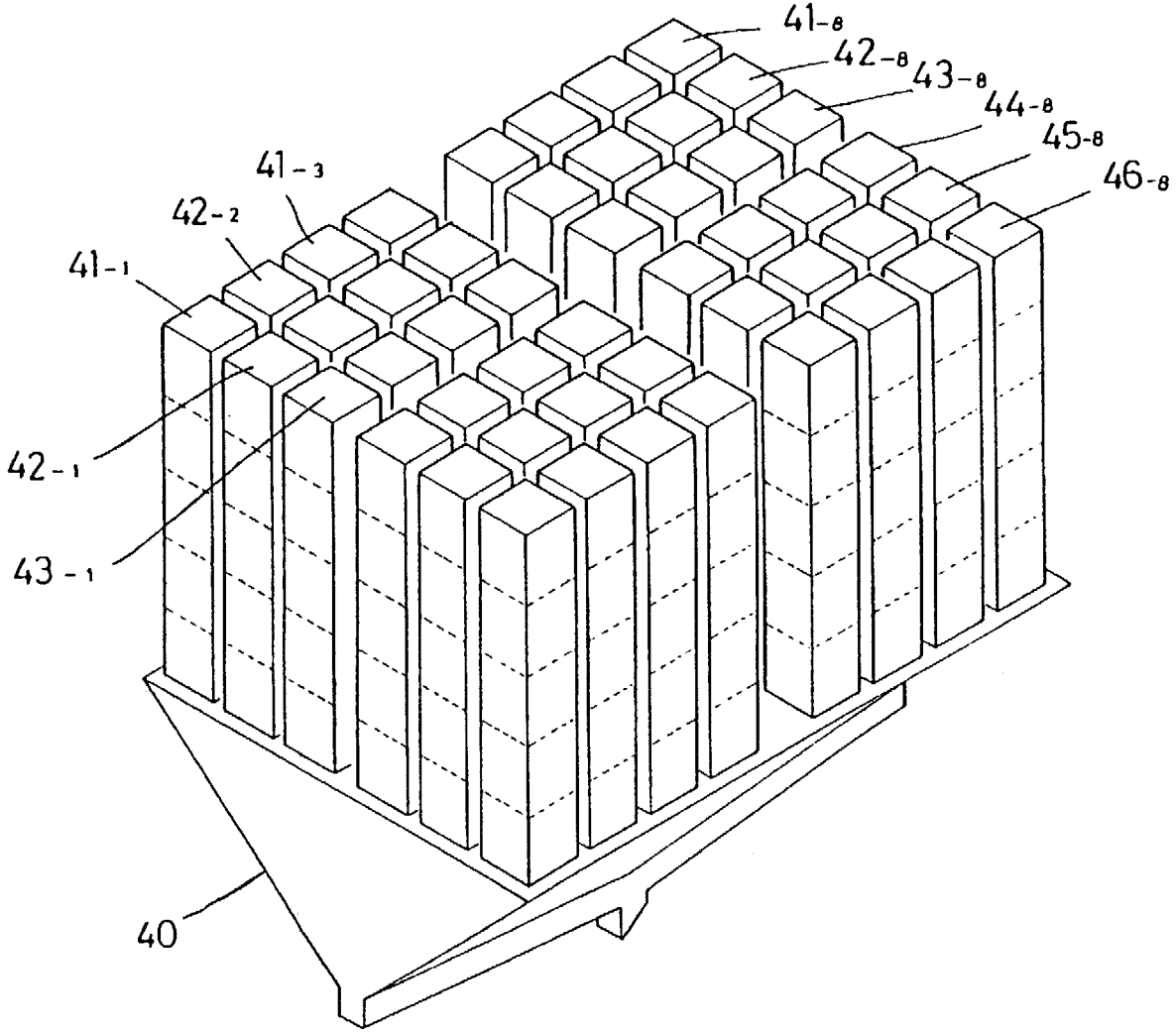
FIG. 17 is a schematic perspective view of a third embodiment of the drug packing apparatus according to the present invention.
Figure 18:
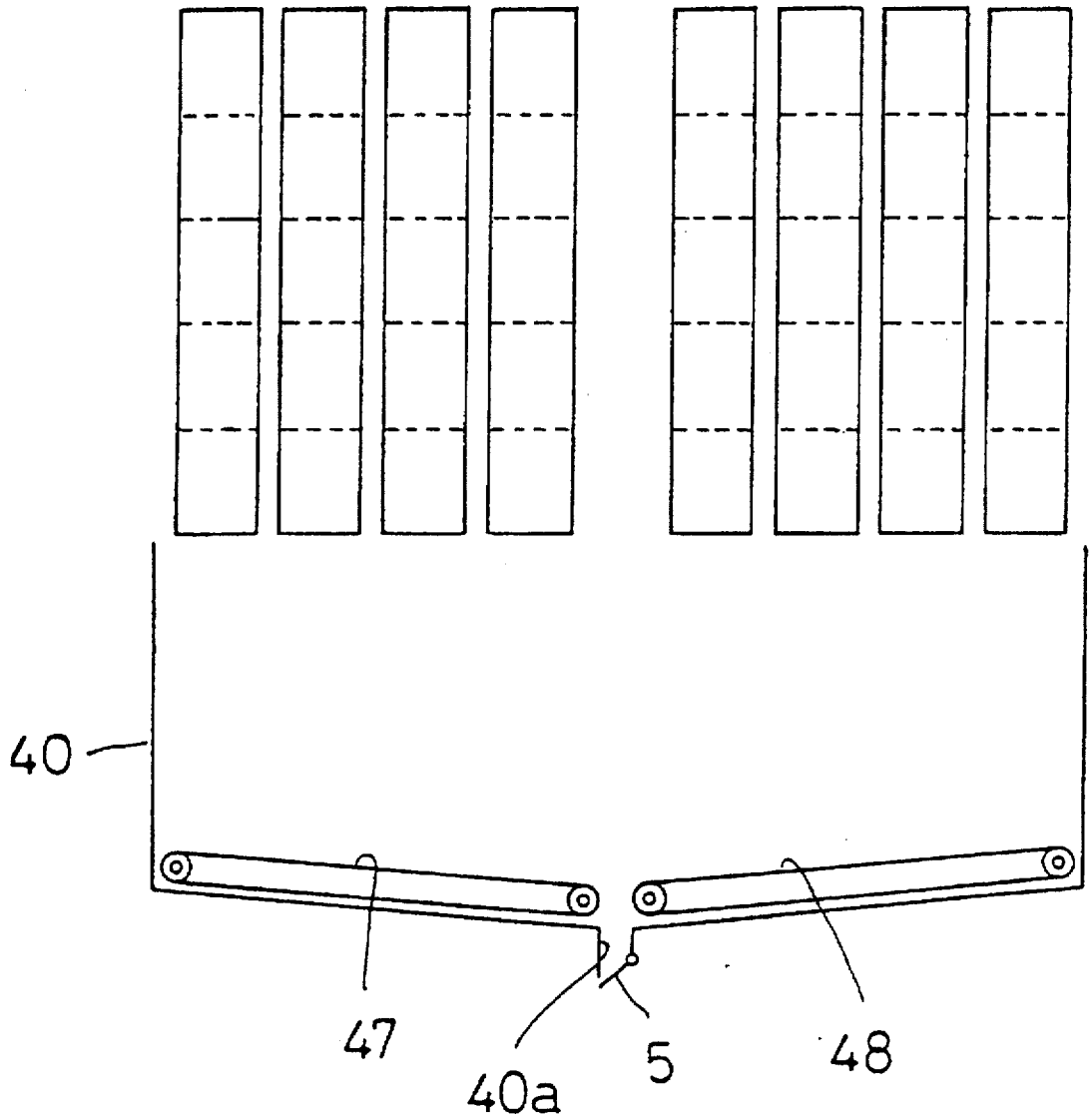
FIG. 18 is a schematic side view of the third embodiment.
Figure 19:
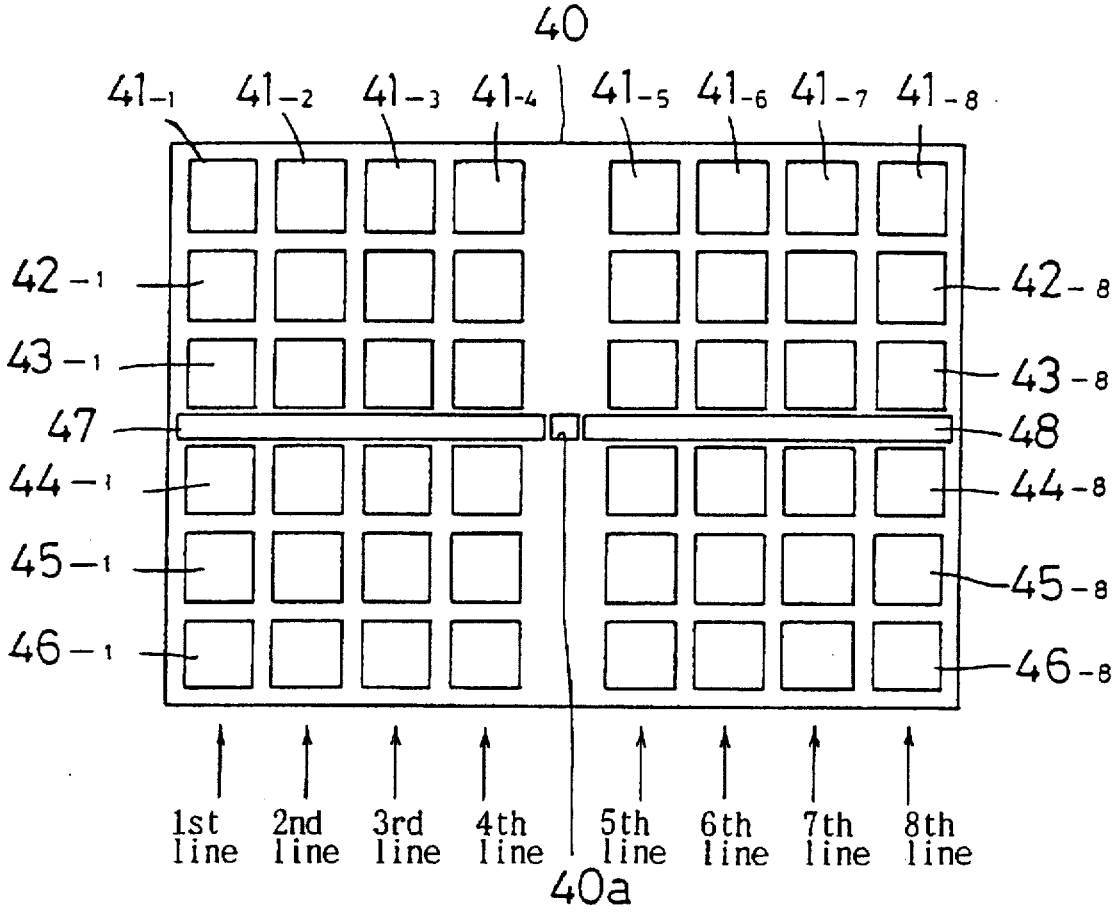
FIG. 19 is a schematic plan view of the third embodiment.

FIG. 17 through 19 show the third embodiment in the drug packing device according to the present invention. FIG. 17 is a perspective view of the device, FIG. 18 is a side view, and FIG. 19 is a plan view of the same.

In the third embodiment is a hopper 40 which is employed, and the hopper is rectangular as seen from the top. Six rows of feeder units $41_{-1}$ to $41_{-8}$, $42_{-1}$ to $42_{-8}$ are arranged.

Five feeders are mounted one over another in each of the feeder units. Each of the feeders is provided with a drug sensor 4 for detecting drugs discharged from the feeders. Also, a cylinder 5 is mounted in each of the feeder units through which the drug can drop. A first shutter 6 and a second shutter 7 are provided inside the cylinder 5. These elements are basically the same as those in shown in FIG. 1.

At the bottom of the hopper 40, a pair of belt conveyors 47 and 48 are mounted. Between the belt conveyors 47 and 48 is provided a discharge hole 40*a* of the hopper 40.

Further, as in the device shown in FIG. 1, the hopper cover 8, motor 9, input unit 14, operation control unit 15, memory unit 16, output unit 17, drug designation unit 21 are provided.

In this embodiment, the feeder units are arranged in lateral and longitudinal rows and the belt conveyors 47 and 48 are mounted at the bottom of the hopper 40. Thus, the moving time of the drugs from the instant when they reach the hopper to the instant they reach the discharge hole 40*a* of the hopper 40 is obtained in a different manner from above.

First, the data table shown in FIG. 7, the drug characteristic data table 33 in FIG. 14, a drug accommodation data table 51 in FIG. 20, a data table 52 for searching feeders' characteristics in FIG. 21, a data table 53 containing feeders' second characteristics in FIG. 22 and a data table 54 containing feeders' third characteristics in FIG. 23 are prerecorded in the memory unit 13.

In the data table 51 shown in FIG. 20 corresponding to the feeder number, the drug names accommodated in the feeders and their characteristics are recorded corresponding to the feeder number.

In the data table 52 in FIG. 21, the first, second and third characteristics of each feeder is recorded. The first characteristic $H_1$–$H_6$ are defined in the data table 26 in FIG. 7.

The feeders' second characteristics $I_1$ to $I_3$ are defined according to the positions of the feeders on the hopper 2 as shown in the data table 53 in FIG. 22. These characteristics are determined according to the positions of the feeders on the hopper 40. In other words, the data table 53 indicating the feeders' second characteristics shows the moving distance "$l_{m2}$" between the landing position of the drug and the opposing end of the belt conveyors 47 and 48. The characteristic $I_1$ is given to the feeders in the feeder units $43_{-1}$ to $43_{-8}$ and $44_{-1}$ to $44_{-8}$ located closest to the belt conveyors 47 and 48, for which the moving distance "$l_{m2}$" of 10 cm is assigned. The characteristic $I_2$ is given to the feeders in the feeder units $42_{-1}$ to $42_{-8}$ and $45_{-1}$ to $45_{-8}$ which are located outside of the units $43_{-1}$ to $43_{-8}$ and $44_{-1}$ to $44_{-8}$. The feeder units $42_{-1}$ to $42_{-8}$ and $45_{-1}$ to $45_{-8}$ have the moving distance "$l_{m2}$" of 20 cm. The characteristic $I_3$ is assigned for the feeders in the feeder units $41_{-1}$ to $41_{-8}$ and $46_{-1}$ and $46_{-8}$ which are located outermost on the hopper and have the moving distance "$l_{m2}$" of 30 cm.

$K_1$ to $K_4$ in the data table 54 in FIG. 22 are defined as the third characteristic of the feeders. These characteristics $K_1$ to $K_4$ denote the carrying time "$t_h$" from the instant when the drug discharged from the feeder reaches the belt conveyor 47 and 48 discharged from the feeder to the instant when it reaches the discharge hole 40*a*, carried by the belt conveyors 47 and 48. The characteristic $K_1$ is given to the fourth and fifth rows of the feeder units which are located closest to the discharge hole 40*a* and the hopper 40. The carrying time "$t_h$" of 0.2 second is preset for $K_1$. The characteristic $K_2$ is given to the third and sixth rows of the feeder units which are the second closest to the discharge hole 40*a* and the carrying time "$t_h$" of 0.4 second is predetermined. The characteristic $K_3$ is given to the second and seventh rows of the feeder units located a little farther from the discharge hole 40*a* with the carrying time "$t_h$" of 0.6 second. The characteristic $K_4$ is given to the first and eighth rows of the feeder units located farthest from the discharge hole 40*a* with the carrying time "$t_h$" of 0.8 second.

By recording these data tables 26, 33, 51, 52, 53 and 54 into the memory unit 13, the operation control unit 15 can collect the information similar to the one shown in FIG. 10. Thus, the operation similar to the one in the flow chart in FIG. 8 can be carried out.

For example, with reference to the data table 51 shown in FIG. 20, it is obtained that the drugs G and R are accommodated in the feeders ($41_{-1}$, $3_{-2}$) and ($42_{-3}$, $3_{-3}$) and have the characteristics $T'_1$ and $T'_4$. Referring to the data table 52 in FIG. 21, the first characteristics of both of the feeders are obtained as $H_2$ and $H_3$, respectively. Then, the dropping time "$t_s$" therefor are obtained as 0.1 second and 0.1 second. The moving velocity corresponding to the characteristics $T'_1$ and $T'_4$ are obtained as 27 cm/sec and 36 cm/sec with reference to the data table 33 in FIG. 14.

Further, with reference to the data table 52 in FIG. 21, the second characteristics of the feeders ($41_{-1}$, $3_{-2}$) and ($42_{-3}$, $3_{-3}$) are obtained as $I_3$ and $I_2$. The moving distance "$l_{m2}$" corresponding to the characteristic $I_3$ is obtained as 30 cm and another "$l_{m2}$" corresponding to the characteristic $I_2$ is obtained as 20 cm.

Referring to the data table 52 in FIG. 21, the third characteristics of the feeders ($41_{-1}$, $3_{-2}$) and ($42_{-3}$, $3_{-3}$) are obtained as $K_4$ and $K_2$. With reference to the data table 54 in FIG. 23, the carrying time "$t_h$" corresponding to these characteristics $K_4$ and $K_2$ are obtained as 0.8 second and 0.4 second.

Thereafter, the moving time "$t_m$" of the drug G from the instant when it reaches the hopper 40 to the instant when the belt conveyors 47 and 48 are obtained by dividing the moving distance "$l_{m2}$" (30 cm) into the moving velocity "$v_m$" (27 cm/sec) of $T'_1$. By adding the carrying time "$t_h$" (0.8 second) of the third characteristic $K_4$ to this moving time "$t_m$", the moving/carrying time "$t_{mh}$" is obtained. In the same manner, the moving time "$t_m$" of the drug G is obtained by dividing the moving distance "$l_{m2}$" (20 cm) into the moving velocity "$v_m$" ( 36 cm/sec ) of $T'_4$, the moving/carrying time "$t_{mh}$" is obtained. By adding the carrying time "$t_h$" (0.8 second) of the third characteristic $K_1$ to this moving time "$t_m$", the moving/carrying time "$t_{mh}$" is obtained.

Since the data consisting of the dropping time "$t_s$", the moving/carrying time "$t_{mh}$" shown in FIG. 10 is now obtained, the operation shown in the flow chart in FIG. 8 can be carried out.

In any of the above embodiments, seven types of drugs were exemplified, but the number of the types is not limited. The moving time and velocity of the drugs can be affected by the action of the drugs such as rolling, sliding and meandering, and thus the maximum amount should preferably be set. Also, it is necessary to change the moving time and velocity of the drugs in accordance with the inclination and the slidability of the hopper.

What is claimed is:

1. A drug packing apparatus comprising a hopper, and a plurality of feeders provided over the hopper for holding different kinds of drugs, said feeders being adapted to drop drugs contained in each of said feeders onto said hopper such that the drugs can be discharged from said hopper through a discharge hole formed in said hopper to pack the drugs, characterized in that said apparatus further comprises a hopper opening means for opening and closing said discharge hole of said hopper, at least one intermediate drug stopper for temporarily stopping the drugs discharged from said feeders and then dropping them onto said hopper, and a control means for controlling said feeders, said intermediate drug stopper and said hopper opening means to drop drugs from said feeders onto said intermediate drug stopper, to hold the drugs temporarily on said intermediate stopper, to drop the drugs from said intermediate drug stopper onto said hopper, to hold the drugs on said hopper opening means, and to activate said hopper opening means, thereby discharging the drugs through said hopper discharge hole, said control means being adapted to compare the time period taken for each drug to drop from said each feeder onto said intermediate drug stopper with the time period taken for each drug to drop from said intermediate drug stopper onto said hopper opening means, and to activate said intermediate drug stopper and said hopper opening means simultaneously when the longer one of said two time periods has passed to drop the drugs on said intermediate drug stopper and said hopper opening means.

2. A drug packing apparatus as claimed in claim 1 wherein said feeders are arranged in at least one vertical row, and wherein said apparatus has a plurality of intermediate drug stoppers provided one over another at different levels from one another, each of said intermediate drug stoppers being adapted to stop drugs dropped from said feeders located higher than at least one of said intermediate drug Stoppers and drugs dropped from an upper one of said intermediate drug stoppers located immediately over a lower one of said intermediate drug stoppers, said control means being adapted to compare the time periods taken for drugs to drop from said feeders to said intermediate drugs stoppers, from said upper one of said intermediate drug stoppers to said lower one, and from a lowest of said intermediate drug stoppers to said hopper opening means, and to activate said intermediate drug stoppers and said hopper opening means simultaneously when the longest one of said time periods has passed to drop drugs on said plurality of intermediate drug stoppers and said hopper opening means.

3. A drug packing apparatus as claimed in claim 2 wherein a plurality of feeder units are provided over said hopper and each of said feeder units comprising a plurality of feeders arranged in a vertical row and a plurality of intermediate drug stoppers provided one over another at different levels from one another, said control means being adapted to compare the time periods taken for drugs to drop from said feeders to said intermediate drug stoppers, from said upper intermediate drug stoppers to said lower one, and from said lowest intermediate drug stoppers to said hopper opening means, to activate said intermediate drug stoppers, and to activate said intermediate drugs stoppers and said hopper opening means simultaneously when the longest one of said time periods has passed to drop drugs on said plurality of intermediate drug stoppers and said hopper opening means.

4. A drug packing apparatus as claimed in claim 1 further comprising a memory means that stores time periods taken for drugs of different types to reach said discharge hole formed in said hopper after landing on said hopper, said control means being adapted to read out from said memory means the time periods corresponding to drugs dropped from said intermediate drug stopper onto said hopper, and to determine the longest one of the time periods thus read out as the time required for the drugs dropped on said hopper to drop onto said hopper opening means.

5. A drug packing apparatus as claimed in claim 1 further comprising a moving speed memory means that stores moving speeds of drugs of different types on said hopper, and a distance memory means that stores the distances between the landing points at which drugs dropped from said intermediate drug stopper landed on said hopper and said discharge hole formed in said hopper, said control means being adapted to read from said moving speed memory means and said distance memory means the respective data corresponding to drugs dropped from said intermediate drug stopper onto said hopper, to determine the moving time periods for the respective drugs dropped onto said hopper until they drop into said discharge hole of said hopper based on the moving speeds and the distances read from said respective memory means, and determine the longest one of said moving time periods as the time required for the drugs dropped on said hopper to drop onto said hopper opening means.

6. A drug packing apparatus as claimed in claim 1 wherein said hopper comprises a belt conveyor, an inclined inner wall for guiding drugs onto said belt conveyor, and a discharge hole through which drugs carried by said conveyor is discharged, and wherein the time period taken for each drug to drop from each of said feeders onto said hopper opening means is equal to the time taken for each drug to drop along said inner wall and be carried by said belt conveyor to said discharge hole.

* * * * *